US009587389B2

(12) United States Patent
Schmed et al.

(10) Patent No.: US 9,587,389 B2
(45) Date of Patent: Mar. 7, 2017

(54) INSERT FOR THE DRAINAGE OPENING OF A URINAL

(75) Inventors: Arthur Schmed, Wollerau (CH); Werner Balkau, Schwandi (CH)

(73) Assignee: URIMAT HOLDING AG, Wollerau (CH)

( * ) Notice: Subject to any disclaimer, the term of this patent is extended or adjusted under 35 U.S.C. 154(b) by 172 days.

(21) Appl. No.: 14/234,655

(22) PCT Filed: Jul. 6, 2012

(86) PCT No.: PCT/EP2012/063211

§ 371 (c)(1),
(2), (4) Date: Jan. 24, 2014

(87) PCT Pub. No.: WO2013/017373

PCT Pub. Date: Feb. 7, 2013

(65) Prior Publication Data

US 2014/0165277 A1 Jun. 19, 2014

(30) Foreign Application Priority Data

Aug. 2, 2011 (DE) ..... 10 2011 052 369

(51) Int. Cl.
*E03D 9/00* (2006.01)
*E03D 13/00* (2006.01)

(52) U.S. Cl.
CPC ..... *E03D 9/005* (2013.01); *E03D 9/007* (2013.01); *E03D 13/00* (2013.01)

(58) Field of Classification Search
CPC ..... E03D 13/005; E03D 13/007; E03D 9/005; E03D 9/002; E03D 9/08
See application file for complete search history.

(56) References Cited

U.S. PATENT DOCUMENTS 3,964,110 A * 6/1976 Kapit ..... A47K 3/001 4/301
5,301,374 A * 4/1994 Smiley ..... E03D 11/025 4/341
6,973,679 B1 * 12/2005 Schad ..... E03D 9/085 4/420.4
7,562,399 B2 * 7/2009 Parsons ..... E03D 1/36 137/426

(Continued)

FOREIGN PATENT DOCUMENTS

CA 1120203 A1 3/1982
CH WO 2010091862 A1 * 8/2010 ..... E03C 1/281

(Continued)

OTHER PUBLICATIONS

Int'l Preliminary Report on Patentability issued Feb. 13, 2014 in Int'l Application No. PCT/EP2012/063211.

*Primary Examiner* — Janie Loeppke
(74) *Attorney, Agent, or Firm* — Panitch Schwarze Belisario & Nadel LLP

(57) ABSTRACT

The invention relates to an insert (3) that can be inserted into a drainage opening (2) of a urinal (1) and that can be designed, for example, as an odor seal. The insert (3) has at least one outlet opening (4) through which a liquid (5), in particular a cleaning and/or disinfecting liquid, is released, in particular injected or sprayed, onto a bowl surface (6) of a urinal (1), in the discharge opening of which the insert (3) is inserted.

22 Claims, 2 Drawing Sheets

(56) References Cited

U.S. PATENT DOCUMENTS

2010/0020573 A1 1/2010 Melanson

FOREIGN PATENT DOCUMENTS

| | | | |
|---|---|---|---|
| CN | 1268203 | A | 9/2000 |
| CN | 2703802 | Y | 6/2005 |
| EP | 0798425 | A2 | 10/1997 |
| FR | 2445416 | A1 | 7/1980 |
| GB | 2 355 185 | A | 4/2001 |
| GB | 2355185 | A | 4/2001 |
| JP | 2003-082741 | A | 3/2003 |
| KR | 20090090711 | A | 8/2009 |
| RU | 2287044 | C2 | 11/2006 |
| WO | WO-2010/091862 | A1 | 8/2010 |
| WO | WO-2010091862 | A1 | 8/2010 |

* cited by examiner

INSERT FOR THE DRAINAGE OPENING OF A URINAL

CROSS-REFERENCE TO RELATED APPLICATIONS

This application is a national stage application (under 35 U.S.C. §371) of PCT/EP2012/063211, filed Jul. 6, 2012, which claims benefit of German application 10 2011 052 369.3, filed Aug. 2, 2011.

TECHNICAL FIELD AND STATE OF THE ART

The invention relates to an insert that can be inserted into a drainage opening of a urinal.

An insert configured as an odor trap is known, for example, from German patent application DE 10 2009 008 574 A1. The odor trap is provided with an inlet surface that has at least one drainage opening that is covered by a covering hood placed onto it. The odor trap has a closure means which, in its basic position, closes the flow-connection between a drain and a drainage opening and which opens when a given amount of urine has flowed into the drain. The closure means has at least two chamber parts that delimit the volume of a chamber, whereby the first chamber part is a membrane part that lifts up from the other, second chamber when a given quantity of liquid has accumulated in the chamber, thereby establishing the flow-connection to the drainage opening.

Another odor trap for a dry urinal is known, for example, from Swiss patent specification CH 694 274 A5. This odor trap comprises a pot with an opening that is located in the upper section in the middle of a ring-shaped inlet surface and that is closed by a closure cap. The closure cap is pressed by a rod from below against the rim of the ring-shaped inlet surface. This closed state is maintained by a magnet located at the lower end of the rod and by another magnet that is installed in the bottom of the pot in that the two magnets having the same polarity repel each other. Once a sufficient quantity of urine and/or flushing water has accumulated on the closure cap, the latter is pushed downwards so that the liquid can drain.

Another type of insert configured as an odor trap for a urinal is disclosed in European patent specification EP 1 076 739 B1. Instead of making use of the closure cap, this odor trap employs a float that floats on top due to the liquid level in the insert and that fits into the opening of the ring-shaped inlet surface.

Such inserts configured as odor traps are used in dry urinals and serve to close the drain leading into the sewage system so as to prevent odors from escaping from the sewage pipes. In addition, such odor traps are supposed to ensure that they completely discharge the urine into the drain so that no residues remain in the area of the odor trap. Water is not used for flushing as is normally done with conventional urinals, thereby saving on the consumption of water. In addition, disinfectant cubes can be placed onto the inlet surface of the odor trap, they are then dissolved by urine, thereby having a cleaning and disinfecting effect.

European patent application EP 1 382 758 A2 discloses a dry urinal having a mechanical odor trap and a bowl without a flushing rim. In this dry urinal, a diaphragm valve closes the drain liquid-tight or gas-tight when in a first position. The diaphragm valve can be switched to a second position in which the urine can drain through the diaphragm valve. In order to simplify the cleaning of the urinal that is operated as a dry urinal, the urinal and the downstream pipe system are flushed with flushing water by means of an externally controlled flushing system at prescribable time intervals. For this purpose, the bowl is provided with a special flushing water distributor that systematically distributes the flushing water in the bowl that does not have a flushing rim. Explicit mention is hereby made of the fact that this urinal should not be provided with a flushing rim. This is especially the case with an eye towards achieving a variable distance between the inlet and outlet of the flushing water connection.

SUMMARY OF THE INVENTION

The present invention is based on the objective of putting forward a modality for cleaning, especially interim cleaning, as well as for disinfecting a urinal, especially a dry urinal.

The objective is achieved by an insert for placement into the drainage opening of a urinal, which is characterized in that the insert has at least one outlet opening for applying, especially for squirting or spraying, a liquid, especially a cleaning and/or disinfectant liquid, onto the surface of the bowl of a urinal into whose drainage opening the insert has been inserted.

The insert according to the invention has the advantage that it creates a simple and reliable modality for applying a cleaning and/or disinfectant liquid onto the surface of the bowl of a urinal into whose drainage opening the insert according to the invention has been inserted. In particular, the insert according to the invention can also be advantageously configured in such a way that already existing urinals, especially dry urinals, can be retrofitted so that cleaning and/or disinfectant liquid can be applied onto the surface of the bowl, preferably electronically controlled.

The insert according to the invention also offers the advantage that, aside from the drainage opening, the urinal does not need to have any other openings in the surface of the bowl through which the cleaning and/or disinfectant liquid can be applied. In particular, there is no need for a flushing rim or for flushing or spraying buttons located in the surface of the bowl. This especially has the advantage that the surface of the bowl can be uninterrupted and can thus be free of openings or edges in which dirt could accumulate. Moreover, such a bowl surface is very easy for personnel to clean since the surface of the bowl can easily be wiped off without there being a need to wipe around additional flushing or spraying buttons.

The insert according to the invention has the special advantage that the time intervals between the cleaning operations to be performed by the personnel can be considerably longer since the insert according to the invention allows interim cleaning operations to take place according to a timetable and/or after a certain number of uses—preferably automatically controlled.

In an advantageous embodiment, the insert is configured as an inlet through which urine can drain. As an alternative, it can also be provided that the insert has an inlet through which urine can drain.

In an especially advantageous embodiment, the insert has an odor trap or else it is part of an odor trap. In an especially advantageous manner, it can be provided that the insert has an odor trap or is configured as part of an odor trap through which urine that has been released into a bowl drains so completely that the urinal into which the insert has been inserted can be operated as a dry urinal.

The above-mentioned embodiments in which the insert has a multiple function can advantageously be configured so as to be especially compact. Particularly with these embodiments, additional installation space is not necessarily needed in order to implement the function of applying cleaning and/or disinfectant liquid.

In an especially advantageous embodiment, the outlet opening is configured as a nozzle. In particular, it can advantageously be provided that the outlet opening is configured as a ring nozzle.

In an especially advantageous embodiment—which can be adapted particularly well to the shape and/or dimensions of the surface of the bowl of a urinal—the size and/or the shape of the outlet opening can be adjusted. As an alternative or additionally, it can also advantageously be provided that the angular position of the outlet opening can be adjusted relative to a urinal into which the insert has been inserted.

With an eye towards adjustability to the specific shape and/or size of the surface of the bowl of a urinal, it can also advantageously be provided that different spray patterns, especially different conical spray patterns or fan-shaped spray patterns can be selected. In particular—as an alternative or in addition—it can also be provided that an asymmetrical spray pattern can be selected. Especially the latter embodiment takes into account the fact that the surface of the bowl of a urinal generally has an asymmetrical shape.

Advantageously, it can be provided that the outlet opening is and/or can be connected directly or indirectly to a reservoir for the liquid or for at least one component of the liquid.

In an advantageous embodiment, the insert has a hood. In particular, it can be provided that the insert has a hood that at least partially surrounds a compartment for a disinfectant cube. The hood can advantageously be provided with passage openings through which urine can come into contact with the disinfectant cube.

In an especially advantageous embodiment, the outlet opening is configured and arranged in such a way that the cleaning and/or disinfectant liquid applied through the outlet opening can be applied so as to flow beyond the disinfectant cube. This advantageously achieves that the disinfectant cube is only consumed when the urinal is actually being used and not when an interim cleaning operation is being carried out.

In an especially advantageous embodiment, a segment of the hood is arranged so that it can be moved and/or rotated. In particular, it can advantageously be provided that a segment of the hood has first passage openings of a first size and/or of a first number in one area, and it has second passage openings of a second size (different from the first size) in a second area (different from the first area), and/or it has a second number (different from the first number) of passage openings, and that the segment of the hood is arranged so that it can be moved and/or rotated in such a way that one of the areas can be oriented towards the user, as desired. Such an embodiment has the advantage that the rate at which the disinfectant cube situated under the hood is consumed can be varied. This is so because the orientation and/or rotational position determines how much urine passes through the hood to reach the disinfectant cube.

Of course, it can be provided that, aside from the first area and the second area, one or more additional areas with different passage openings are present in the segment.

An especially advantageous urinal, especially a dry urinal, is one whose drainage opening contains an insert according to the invention.

In an advantageous embodiment of such a urinal, a reservoir for a cleaning and/or disinfectant liquid that can be applied through the outlet opening is provided. In particular, it can advantageously be provided that the insert is and/or can be connected directly or indirectly to a reservoir for a cleaning and/or disinfectant liquid.

In an especially advantageous embodiment, it is provided that the outlet opening is automatically connected to a reservoir that is arranged in the urinal itself. Here, it can advantageously be provided that the urinal, on the one hand, and the insert, on the other hand, have connection elements that automatically engage with each other, especially positively driven, when the insert is inserted into the drainage opening of the urinal.

In an advantageous urinal, the outlet opening is configured and arranged in such a way that the liquid coming out of the outlet opening wets virtually the entire surface of the bowl of the urinal. As already mentioned, this can be achieved, for instance, in that the size and/or the shape of the outlet opening and/or the angular orientation of the outlet opening and/or the spray pattern is/are adapted to the geometry and the size of the urinal.

In an especially advantageous embodiment, a replaceable reservoir is provided for the liquid or for a component of the liquid. In particular, the reservoir can advantageously be configured as a disposable container. Such an embodiment has the special advantage that the reservoir does not have to be laboriously refilled by the user, but rather, the user merely has to put a new reservoir in place when the previous reservoir is empty.

In a special embodiment in which the reservoir is particularly easy to put in place, the reservoir has a sealing membrane that is configured and arranged so that it is punctured by at least one suction tube when the reservoir is put in place. This embodiment has the special advantage that the user can put the reservoir in place directly, without first having to open a seal. Moreover, such an embodiment has the advantage that the sealing membrane is not punctured until the connection position has been reached, thereby ensuring that no cleaning and/or disinfectant liquid can spill before that.

In an especially advantageous embodiment, a bayonet catch or a clip fastener is provided to temporarily secure the reservoir in a connection position.

In an advantageous embodiment, the reservoir is configured as a disposable container and it has a fastening element to temporarily secure it in a connection position. The fastening element is configured in such a way that it is automatically mechanically destroyed when the reservoir is removed. This embodiment has the very special advantage that it effectively prevents the re-attachment of a reservoir once it has been removed. In particular, this prevents unsuitable and/or impermissible liquids from being filled into a reservoir that has already been used and emptied, as a result of which impermissible and/or unsuitable liquids would be applied to the urinal instead of the liquid actually intended for this purpose.

This aspect is especially important since it must be ensured at all times that the urinal meets prescribed hygiene requirements and that no liquids are used that could damage the urinal or that could be harmful to health.

In order to facilitate the placement of a reservoir into the urinal, in an advantageous manner, a guide—preferably conical—can be provided. Such an embodiment has the very special advantage that the user can put the reservoir in place without having to be able to see the connection position. This makes it possible, for example, to put the reservoir in place into the urinal from below without having to lie on the floor.

In an especially advantageous embodiment, a filling level display is provided that displays information pertaining to the filling level of the cleaning and/or disinfectant liquid in the reservoir. In particular, a filling level display can advantageously be provided that emits light of different colors, depending on the filling level of the cleaning and/or disinfectant liquid. One or more light sources can be provided to emit the light. In particular, it lends itself to use light-emitting diodes in one or more colors.

In a special embodiment, a light-emitting diode is used that can light up in three colors, namely, for example, red, yellow and green. As long as the reservoir is at least half full, the green light source lights up. Once the reservoir reaches a filling level between one-fourth and half of the maximum filling level, the yellow light source lights up. As soon as the reservoir reaches a filling level that is less than one-fourth of the maximum filling level, the red light source lights up. Of course, it is also possible to use just two colors or else more than three colors, depending on how detailed the information about the filling level is supposed to be.

In an especially advantageous embodiment, the filling level display has at least one optical waveguide, especially an optical fiber. This embodiment has the very special advantage that the light source, along with its electric connections, can be arranged outside of the area that runs the risk of coming into contact with cleaning and/or disinfectant liquid and/or with urine. Rather, with this embodiment, the light emitted by the light source(s) is transported via an optical waveguide into an area where the user can see the light. This area can even be an inlet opening for urine or for the cleaning and/or disinfectant liquid since an arrangement with an optical waveguide—unlike an electric arrangement—is not sensitive to liquid. In particular, no short circuits can occur.

In a special embodiment, an inlet connection, especially a fresh water connection, is provided for water. This embodiment especially has the advantage that, for example, the reservoir can contain a concentrate to which water is added in order to create the that is to be applied.

In an advantageous urinal, a mixing device is provided that mixes at least two components in order to create the liquid. In particular, a mixing device can be provided that mixes at least two components in order to create the liquid, whereby one component is a cleaning and/or disinfectant liquid while another component is water.

In an advantageous urinal, at least one pump, especially a metering pump, is provided in order to convey and/or meter the liquid or a component of the liquid. In an advantageous manner, the pump can be configured, for example, as an electric oscillating piston pump. Such an oscillating piston pump has the very special advantage that it is inexpensive and has a long service life, while permitting highly precise metering.

In an advantageous embodiment of a urinal according to the invention, an electronic unit is provided that controls the mixing ratio of the liquid and/or that controls the mixing of components of the liquid and/or that controls the amount of the liquid that is to be applied onto the surface of the bowl.

In an advantageous embodiment of a urinal according to the invention, a preferably automatic time or interval control for the application of the liquid is provided. In particular, a detection device can be provided that detects the number of uses of the urinal so that the application of the liquid onto the surface of the bowl can be triggered—preferably automatically controlled—after a prescribed and/or prescribable number of uses—for example, by means of an electronic control unit.

This embodiment has the special advantage that the application takes place exclusively when it is necessary. In this manner, in particular, cleaning and/or disinfectant liquid can be saved.

In an advantageous embodiment, the application of the liquid onto the surface of the bowl is triggered automatically. For example, it can especially be provided that the application is controlled as a function of the time of day or as a function of a schedule. Such an embodiment has the advantage that, at those times when the urinal is used more often, a more frequent application can take place, whereas at times when it can be expected that the urinal will be used less often, the application can take place less frequently.

If the liquid in the reservoir contains partial components that tend to de-mix or clump together, in an advantageous manner, a device for stirring or circulating the liquid can be provided. Such a circulation procedure can advantageously be carried out in that liquid is withdrawn from the reservoir and fed to a pump that then pumps the withdrawn liquid back into the reservoir.

In an advantageous embodiment, the urinal comprises a base body that has a compartment for at least one functional component and/or for at least one reservoir and/or for an electronic control unit and/or for at least one pump, whereby the base body also preferably has the bowl. Such an embodiment entails the very special advantage that the urinal can be very compact on the one hand and also very sturdy on the other hand. A special advantage here is that, thanks to the compartment, the components that are accommodated therein are well protected against external influences. In particular, the components arranged in the compartment are especially well protected against manipulation. Moreover, such a urinal can be cleaned easily without the risk of damaging the individual components during a cleaning procedure. Preferably, the electronic components are arranged so as to be protected against splashing water since it can happen that the cleaning personnel uses power washers for the cleaning work.

Additional objectives, advantages, features and application possibilities of the present invention can be gleaned from the description below of an embodiment making reference to the drawing. In this context, all of the described and/or depicted features on their own or in any meaningful combination constitute the subject matter of the present invention; this also applies irrespective of their compilation in the claims and irrespective of the claims to which they refer back.

DESCRIPTION OF THE DRAWINGS

The following is shown.

DETAILED DESCRIPTION OF EMBODIMENTS

Figure 1:
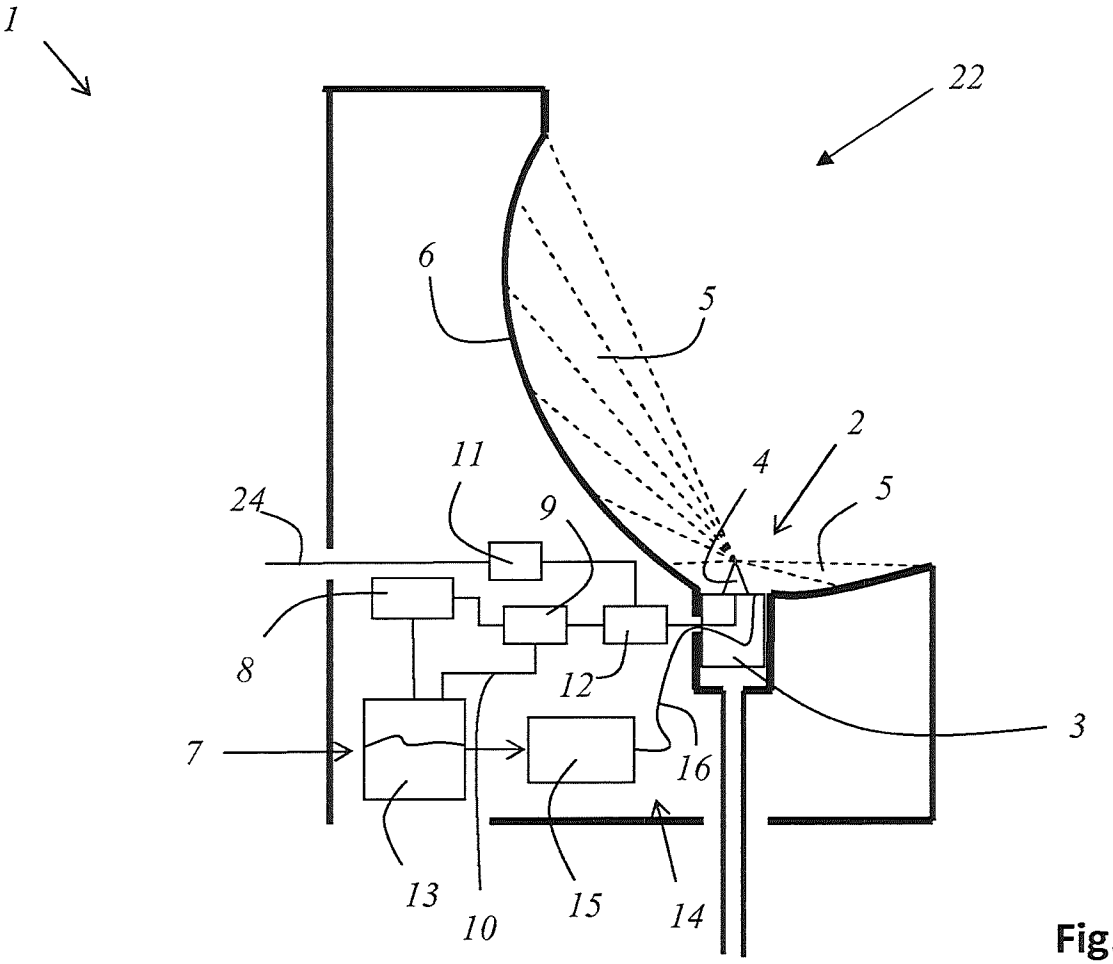
FIG. 1 is a urinal with an insert according to the invention.

FIG. 1 shows a urinal 1 with a drainage opening 2 into which an insert 3 has been inserted. The insert 3 has an outlet opening 4 configured as a nozzle through which a liquid 5 can be applied, namely, sprayed, onto the surface 6 of the bowl of the urinal 1. The insert 2 is configured as an inlet through which urine can drain. Moreover, the insert 2 is additionally configured as an odor trap through which urine that has been released into the bowl 22 drains so completely that the urinal 1 can be operated as a dry urinal.

The outlet opening 4 is configured and arranged in such a way that the liquid 5 coming out of the outlet opening 4 wets virtually the entire surface 6 of the bowl of the urinal 1.

The urinal 1 has a reservoir 7 for a concentrate 13. In order to mix the concentrate 13, especially before an application procedure, it is provided that is it thoroughly mixed. Here, a pump 8 withdraws concentrate 13 from the reservoir 7 and—controlled by a 3/2 valve 9—returns it to the reservoir via a return line 10. This circulation procedure thoroughly mixes the concentrate 13. The urinal 1 has a fresh water feed line 24. The fresh water feed is controlled by a 2/2 valve 11. A mixing device 12 that receives fresh water as well as concentrate 13—when the 3/2 valve 9 is in the appropriate position—from the reservoir 7 mixes the liquid 5 that is to be applied and subsequently conveys it to the outlet opening 4.

The urinal 1 has a filling level display 14 with a light source 15 and a flexible optical waveguide 16. The light source 15 generates light whose color depends on the filling level of the reservoir 7. The generated light is transported by means of the flexible optical waveguide 16 to the insert 3. The user can see there whether the reservoir is still sufficiently full. A display directly on the insert is especially advantageous since this can be seen very clearly.

Figure 2:
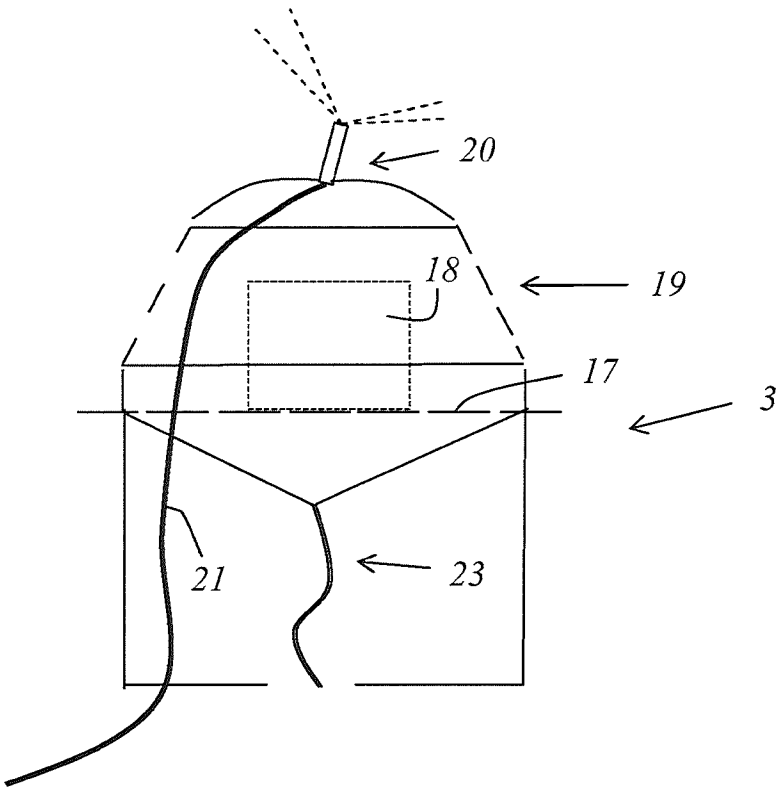
FIG. 2 is a detailed view of an insert according to the invention inserted into a urinal.

FIG. 2 shows an insert 3 according to the invention that is configured as an inlet and as an odor trap. For purposes of creating a gas-tight seal, the insert has a tube valve 23. Moreover, a gasket is provided between the insert 3 and the urinal bowl.

Furthermore, the insert has a sieve 17 on which a disinfectant cube 18 can be positioned. Above the disinfectant cube 18, there is a hood 19 that partially covers the disinfectant cube. In the hood 19, there is a segment that can rotate around the axis of symmetry of the insert and that has passage openings through which urine can come into contact with the disinfectant cube. The segment 19 has different areas with passage openings of different sizes. By rotating the segment, an area can be oriented towards the user. This embodiment has the special advantage that the consumption of the disinfectant cube can be controlled in that the openings that are oriented towards the user are those through which a large quantity of urine can reach the disinfectant cube.

At the tip of the hood 19, there is an outlet opening 4 that is configured as a ring nozzle for dispensing a liquid, especially a cleaning and/or disinfectant liquid, onto the surface of the bowl of a urinal into whose drainage opening the insert 3 has been inserted. Via a tube 21, the outlet opening 20 receives the liquid to be dispensed.

The invention was described in conjunction with one or more special embodiments. It goes without saying, however, that changes and modifications can be undertaken without departing from the protective scope of the claims below.

LIST OF REFERENCE NUMERALS

1 urinal
2 drainage opening/insert
3 insert
4 outlet opening
5 liquid
6 surface of the bowl
7 reservoir
8 pump
9 3/2 valve
10 return line
11 2/2 valve
12 mixing device
13 concentrate
14 filling level display
15 light source
16 optical waveguide
17 sieve
18 disinfectant cube
19 hood
20 outlet opening
21 tube
22 bowl
23 tube valve
24 fresh water inlet

The invention claimed is:

1. An insert (3) adapted for insertion into a drainage opening (2) of a urinal (1), comprising:

a structure installed over or inserted into the drainage opening (2) of said urinal (1), wherein said drainage opening (2) is in a bottom portion of said urinal (1), said structure having a nozzle that sprays a cleaning and/or disinfectant liquid (5) upwardly from the drainage opening onto a surface (6) of a bowl of the urinal (1) into which the structure has been installed or inserted, said structure further defining at least one inlet through which urine drains into the drainage opening (2); and a fluid connection between the nozzle and a reservoir (7) for retaining the cleaning and/or disinfectant liquid (5) or retaining a component of such cleaning and/or disinfectant liquid (5), said fluid connection adapted for conveying the cleaning and/or disinfectant liquid (5) from the reservoir (7) to the nozzle.

2. The insert (3) according to claim 1, further comprising: an odor trap, either integral with or separate from the structure, through which urine that has been released into the bowl drains so completely that the urinal (1) into which the insert (3) has been inserted can be operated as a dry urinal.

3. The insert (3) according to claim 1, wherein the nozzle is configured to be adjustable either as to its size or its shape or its angular position relative to the urinal (1) into which the insert (3) has been inserted.

4. The insert (3) according to claim 1, wherein the nozzle is configurable to emit cleaning and/or disinfectant liquid (5) in at least one spray pattern selected from the group consisting of: conical spray patterns, fan-shaped spray patterns, symmetrical spray patterns, and asymmetrical spray patterns.

5. The insert (3) according to claim 1, further comprising a hood (19) that at least partially surrounds a compartment for a disinfectant cube (18).

6. The insert (3) according to claim 5, wherein the hood (19) has a tip, and the nozzle is arranged at the tip of the hood (19).

7. The insert (3) according to claim 5, wherein a segment of the hood (19) is movable or rotatable.

8. The insert (3) according to claim 5, wherein a segment of the hood (19) defines first passage openings of a first size and/or of a first number in a first area, and defines second passage openings of a second size (different from the first size) in a second area (different from the first area), and/or defines a second number (different from the first number) of passage openings, and wherein the segment of the hood (19) is selectively movable or rotatable to orient one of the areas towards a user.

9. A urinal (1), comprising:

a bowl defining a surface (6) and having a drainage opening in a bottom portion of the surface (6) leading from the bowl to a drain;

an insert (3) installed at least in part in the drainage opening of the urinal (1), said insert (3) defining an outlet opening (4) from which a cleaning and/or disinfectant liquid (5) is sprayed to direct said liquid (5) upwardly onto the surface (6) of the bowl of the urinal (1), and defining at least one inlet through which urine drains into the drainage opening;

a reservoir (7) for the cleaning and/or disinfectant liquid or a component of such liquid; and a fluid connection between the outlet opening (4) and the reservoir (7), said fluid connection adapted for conveying the cleaning and/or disinfectant liquid (5) from the reservoir (7) to the outlet opening (4).

10. The urinal (1) according to claim 9, wherein the outlet opening (4) is configured to direct the liquid (5) onto substantially the entire surface (6) of the bowl of the urinal (1).

11. The urinal (1) according to claim 9, wherein the reservoir (7) is replaceably inserted into the urinal (1).

12. The urinal (1) according to claim 11, wherein the reservoir (7) is configured as a disposable container and has a fastening element to temporarily secure the reservoir (7) in a connection position in the urinal (1).

13. The urinal (1) according to claim 9, further comprising a guide in order to guide the reservoir (7) into position.

14. The urinal (1) according to claim 9, further comprising a filling level display (14) pertaining to the filling level of the cleaning and/or disinfectant liquid in the reservoir (7).

15. The urinal (1) according to claim 14, wherein the filling level display (14) has at least one optical waveguide (16).

16. The urinal (1) according to claim 9, further comprising an inlet connection for water.

17. The urinal (1) according to claim 9, further comprising a mixing device (12) that mixes at least two components in order to create the liquid (5), wherein one component is a cleaning and/or disinfectant liquid while another component is water.

18. The urinal (1) according to claim 9, further comprising at least one pump (8) to convey and/or meter the liquid (5) or a component of the liquid (5).

19. The urinal (1) according to claim 17, further comprising an electronic unit to control the mixing of components of the liquid (5) and/or the amount of the liquid (5) that is to be emitted from the outlet opening (4) and applied onto the surface (6) of the bowl.

20. The urinal (1) according to claim 9, further comprising a detection device to detect the number of uses of the urinal, and an electronic control unit to trigger when the liquid (5) emitted from the outlet opening (4) is applied onto the surface (6) of the bowl.

21. The urinal (1) according to claim 9, wherein the urinal (1) further comprises a base body that has a compartment for at least one functional component and/or for at least one reservoir (7) and/or for an electronic control unit and/or for at least one pump (8), and wherein the base body has the bowl (6).

22. The urinal (1) according to claim 9, wherein the surface (6) of the urinal (1) lacks any other opening besides the drainage opening.

* * * * *